United States Patent [19]

Harrington et al.

[11] Patent Number: 4,738,635

[45] Date of Patent: Apr. 19, 1988

[54] APPARATUS FOR FIELD ASSEMBLING A TELEPHONE CONNECTION APPARATUS

[75] Inventors: Susan M. Harrington, Colonia; Sidney Levy, Belle Mead, both of N.J.

[73] Assignee: Thomas & Betts Corporation, Bridgewater, N.J.

[21] Appl. No.: 811,121

[22] Filed: Dec. 19, 1985

[51] Int. Cl.[4] ..... H01R 13/58

[52] U.S. Cl. ..... 439/452; 439/458; 439/640; 439/676

[58] Field of Search ..... 339/154, 156, 103 R, 339/103 M, 208, 210 R, 210 M, 107; 439/171

[56] References Cited

U.S. PATENT DOCUMENTS

| | | | |
|---|---|---|---|
| 3,170,749 | 2/1965 | Johanson et al. | 339/107 |
| 3,699,498 | 10/1972 | Hardesty et al. | 339/64 |
| 3,758,935 | 9/1973 | Long et al. | 29/203 |
| 3,761,869 | 9/1973 | Hardesty et al. | 339/99 |
| 3,904,265 | 9/1975 | Hollyday et al. | 339/208 |
| 4,040,699 | 8/1977 | Rasmussen | 339/91 |
| 4,239,320 | 12/1980 | Hesse et al. | 439/171 |
| 4,290,664 | 9/1981 | Davis et al. | 339/156 R |
| 4,335,929 | 6/1982 | Abernethy | 339/154 A |
| 4,387,501 | 6/1983 | Rix | 29/566 |
| 4,392,701 | 7/1983 | Weidler | 339/156 R |
| 4,488,768 | 12/1984 | Sigmon | 339/99 |
| 4,555,158 | 11/1985 | Lam | 339/99 |

OTHER PUBLICATIONS

Western Electric Advertising Literature, Author unknown, undated, p. 12.

*Primary Examiner*—Gil Weidenfeld
*Assistant Examiner*—David Pirlot
*Attorney, Agent, or Firm*—Robert M. Rodrick; Salvatore J. Abbruzzese

[57] ABSTRACT

A modular telephone connector splitter/adapter is disclosed. A housing supports a plurality of modular connectors in input and output configurations to permit formation of a modular telephone splitter in which an input can be divided into multiple outputs. The input can also be a conventional telecommunications cable wherein the housing serves as a cable splitter.

8 Claims, 4 Drawing Sheets

FIG. 10
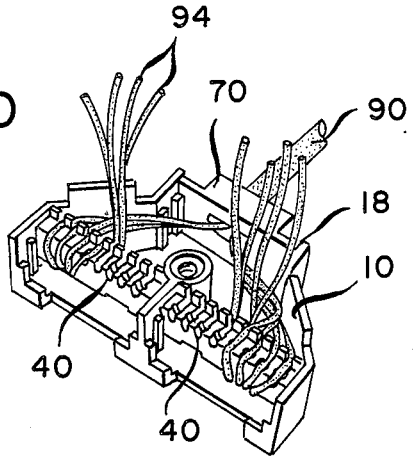
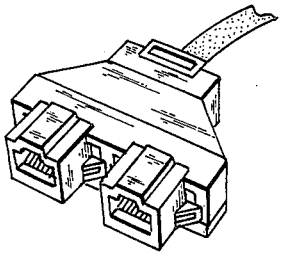
FIG. 11
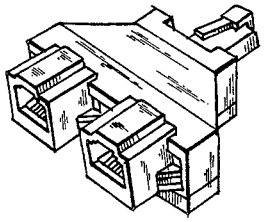
FIG. 12
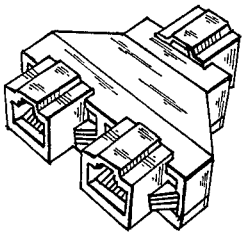
FIG. 13

APPARATUS FOR FIELD ASSEMBLING A TELEPHONE CONNECTION APPARATUS

FIELD OF INVENTION

This invention relates generally to a method and apparatus for assembling a telephone connection device and more particularly relates to a kit of parts which can be assembled in the field to form a telephone connection adapter and splitter.

BACKGROUND OF THE INVENTION

With the recent decentralization in the telecommunications industry there has been rapid growth in the area of telephone equipment, especially the area of modular telephone connectors. These connectors are usually supplied in an industry standard, factory assembled jack or plug configuration. Commercial connectors, such as shown in U.S. Pat. No. 3,699,496, include jack or plug connectors which are typically factory assembled to telephone cable for installation on sight on a modular basis.

An obvious outgrowth of these modular connectors has been the use of modular adapters which allow a single modular input to be broken out into plural modular outputs. The natural extension of this technique is to use a splitter which accepts a single, multiconductor telephone cable and splits that cable into plural modular outputs. However, as with telephone connectors above described, these modular splitters and adapters are all factory assembled having inputs and outputs fashioned into the industry standard jack or plug configuration. Thus, for example, there may be one adapter having a plug input and two jack outputs and a second adapter having a jack input and two jack outputs. It can be seen that there can be many permutations and combinations of jacks and plug each of which must be separately factory constructed.

The telephone connection industry has seen the advent of a field installable, modular connection apparatus. In U.S. patent application, Ser. No. 577,109, filed Feb. 6, 1984, entitled "Field Installable Modular Telephone Connector", a method and apparatus is described whereby a modular telephone connector can be assembled to a given length of cable in the field without need for factory pre-assembly. This permits the telephone installer to assemble a connector of a given type and terminate that connector to a given length of cable at the site thereby eliminating the need to carry multiple, modular connectors of different types which are assembled to fixed lengths of cable. This greatly reduces the inventory that a telecommunications installer need have at his disposal at any given site. Likewise, it is desirable to provide a modular splitter and adapter which can be assembled in the field into any selected combination that is necessary, at a particular location without having to carry multiple different splitters and adapters which are factory pre-assembled.

SUMMARY OF THE INVENTION

It is an object of the present invention to provide a telephone connection apparatus for serving as a cable splitter or modular adapter.

It is a further object of the present invention to provide a field assemblable telephone connection adapter and splitter which can be formed into numerous configurations without factory pre-assembling.

In the efficient attainment of these and other objects, the present invention looks toward providing a kit of parts for field assembling a telephone connection apparatus comprising a body having an input port and an output port. A modular connector is adapted for insertable attachment to either the input or output port. Each of the connectors include a termination end and a connection end and have plural electrical contacts extending therebetween. An attachment element is adapted for insertable attachment to the other of the input or output ports for securing conductive members for electrical connection to the contacts of the modular connector. A cover engagable with the body member holds the connector and the input element in the body member.

Described in more detail by way of preferred embodiment herein, the present invention includes a housing having an input port and two output ports. The input port receives either a telephone cable for splitting or a modular connector for serving as an adapter. Two other modular connectors are insertable at the output port. Electrical contacts in each of the modular connectors are electrically connected by either using longitudinal extents of insulated conductors or the wires provided in the telecommunications cable. The apparatus can be field assembled into any configuration desired for a particular application.

BRIEF DESCRIPTION OF THE DRAWINGS

FIGS. 9 and 10 show sequentially, the steps employed in forming a cable splitter in accordance with the present invention.

FIGS. 11, 12 and 13 show various adapter/splitter combinations which can be constructed in accordance with the present invention.

DETAILED DESCRIPTION OF THE PREFERRED EMBODIMENT

The present invention provides in separate component form, elements which can be combined to form a field installable, telephone cable splitter or a field installable connector adapter. As used in the present invention, the term "splitter" refers to the technique of splitting discrete insulated conductors of a telecommunications cable into two or more modular connectors. The term "adapter" refers to dividing an input from one modular connector into one or more outputs of a modular connector which may or may not be of the same type as the input. The term "field installable" refers to the assembling of the splitter or adapter by the end user as opposed to factory pre-assembly of components.

Figure 1:
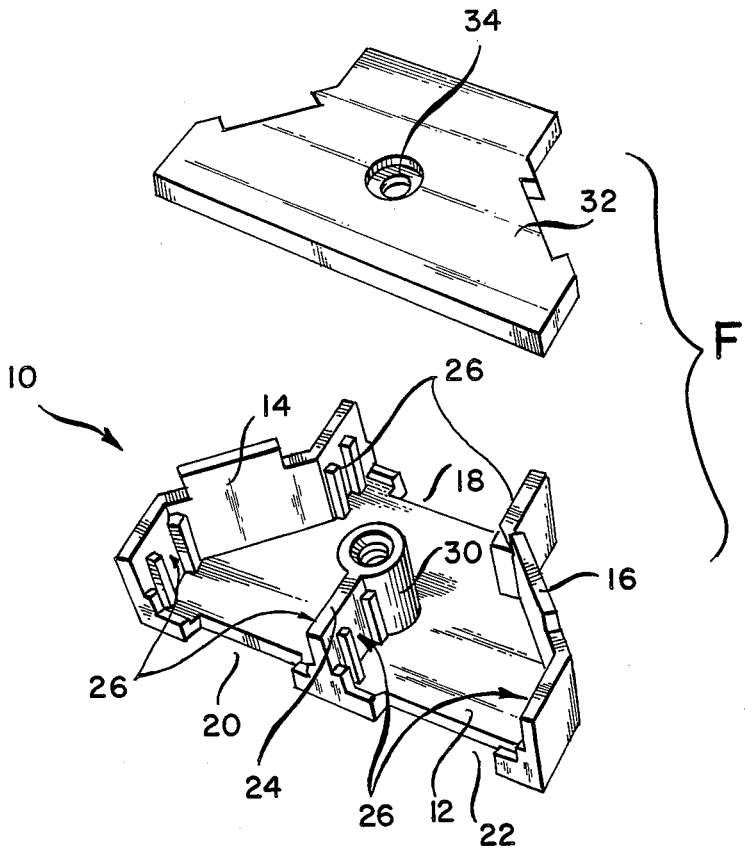
FIG. 1 shows an exploded perspective view a housing and cover which form the apparatus of the present invention.

Referring to FIG. 1, there is shown a housing 10 which may form the splitter or adapter of the present invention. Housing 10 is an integrally formed plastic member including a flat base 12 and a pair of upstanding side walls 14 and 16. Housing 10 is generally triangular in shape having an input port 18 on one side thereof and a pair of output ports 20 and 22 opposite input port 18. A central dividing wall 24 separates and electrically isolates output ports 20 and 22. The presently described invention shows a single input port and a pair of output ports. However, it is contemplated that any number of input ports and output ports may be constructed in accordance with the present invention.

Housing 10 further includes adjacent both sides of ports 18, 20 and 22, wall slots 26 which provide for slidable insertion from above of other elements of the present invention as will be described in greater detail hereinbelow. Housing 10 also includes a central cylindrical post 30 for accommodating a conventional screw 82 (FIG. 8) or similar fastening means. A plastic cover 32 which is formed in complementary shape to housing 10 is inserted over housing 10 to close the upper end thereof. Cover 32 includes a central aperture 34 which aligns with cylindrical post 30 to accommodate a mounting screw 82 to secure the cover 32 to the housing 10.

Figure 2:
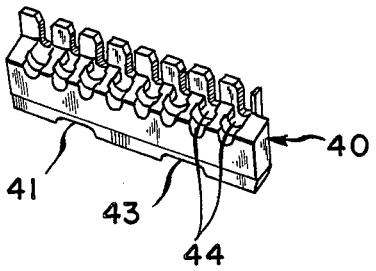
FIG. 2 shows, in front perspective view, a wire insert member which is inserted into the housing shown in FIG. 1.

Referring now to FIG. 2, an insert member 40 is shown. Insert member 40 is an elongate plastic member which is insertably received in housing 10 and supported across the input and output ports by slots 26 in the walls of housing 10. Insert 40 includes, along the upper surface thereof discrete channels 44 which typically accommodate insulated conductors of a multiconductor telephone cable, or jumper wires as will be described in further detail hereinbelow. While eight channels are shown, inserts having fewer channels may be employed to accommodate cables having fewer conductors. Also, the eight channel insert may be employed with the non-used channels 44 remaining empty.

Figure 4:
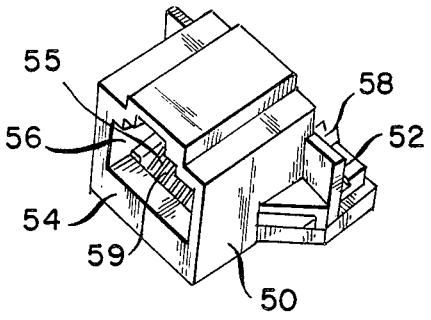
FIGS. 4 and 5 show respectively, a jack and a plug-type modular connector which may be assembled to the housing shown in FIG. 1.
Figure 5:
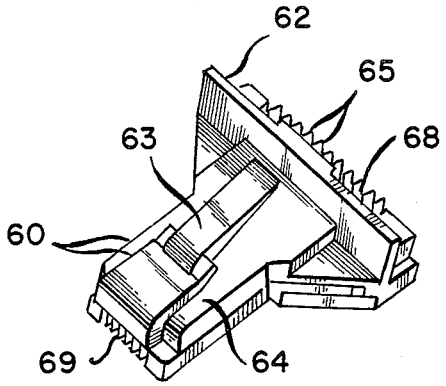

Referring now to FIGS. 4 and 5, there is shown a modular connector formed respectively into a jack and plug which may be accommodated at the input or output ports of housing 10. FIG. 4 shows a jack 50 having a termination end 52 and a connection end 54 including a jack opening 56. Plural elongate electrical contacts 55 extend from the termination portion 52 into the jack opening 56. Each contact 55 includes an insulation displacing portion 58 at the termination end and a contact portion 59 in the jack opening 56. Plug 60, shown in FIG. 5, includes a termination end 62 and connection end 64 which is formed into a plug nose. A latch assembly 63 secures plug 60 to jack 50. Electrical contacts 65 extend from the termination end 62 to the plug nose 64 and include insulation displacing contacts 68 at the termination end and contact portions 69 at the plug nose 64.

An industry standard exists that to the configuration of the jack 50 and its opening 56 as well as the geometry of the plug nose 64 which permits mating upon interconnection of the plug and jack. Likewise, the contact elements in both the plug 60 and the jack 50 also conform to an industry standard. The latch 63 on plug 60 is insertable into the upper portion of opening 56 of jack 50 and also in industry standard construction, lock the plug 60 into the jack 50.

Figure 8:
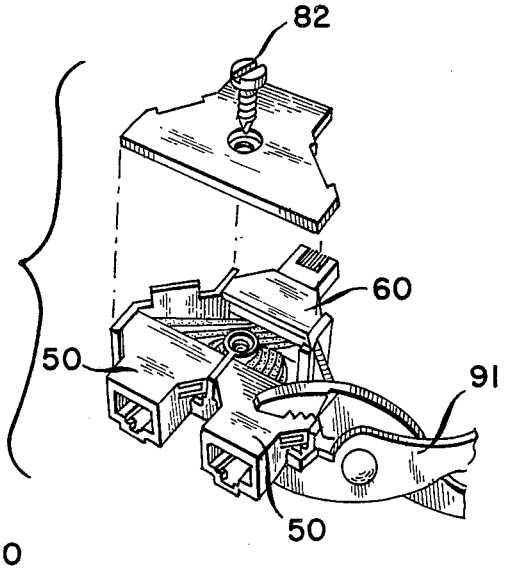

A modular connector of either the jack 50 or plug 60-type is insertable into any of the input port 18 or output ports 20 and 22, in reverse orientation FIG. 8). The insulation displacing portions 68 and 58 of plug 60 and jack 50 respectively, are insertably received in similar fashion in insert 40. One insulation displacing contact is insertable into a unique one of the discrete channels 44. The insulation displacing contacts will electrically terminate the insulated conductor secured in channel 44. The termination of insulated conductors in jack 50 or plug 60 is shown and described in U.S. patent application Ser. No. 577,109, filed Feb. 6, 1984, and assigned to the assignee of the present invention. This application is hereby incorporated by reference for all purposes.

Figure 3:
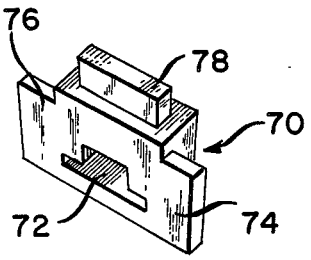
FIG. 3 shows a strain relief attachment member which is also insertable into the housing shown in FIG. 1.

Referring now to FIG. 3, a strain relief attachment member 70 is shown. Attachment member 70 is a plastic element having a central aperture 72 therethrough. A pair of wings 74 and 76 are slidably insertable into housing 10 adjacent input 18, so that housing 10 may accommodate a telecommunications cable 90 (FIG. 9) therein. An engagement member 78 situated over aperture 72 can be moved down into the aperture 72, to crimp a portion of the cable, securing the cable in the attachment member 70. The engagement member 70 may be inserted into input port 18 with cable 90 secured therein to form a cable splitter.

Having described the various elements of the splitter-/adapter of the present invention, examples of its use may oe described.

Figure 6:
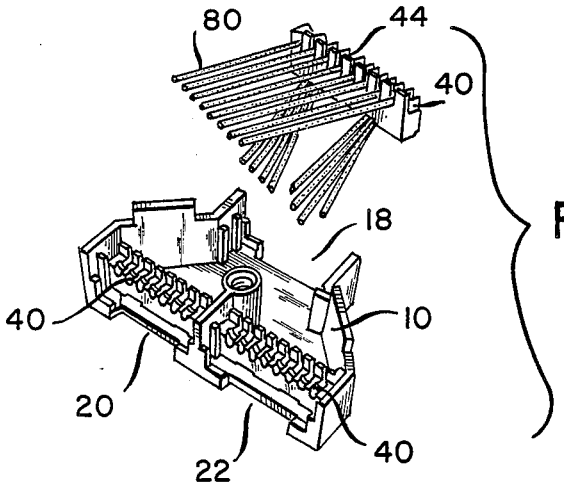
FIGS. 6, 7 and 8 show sequentially, the steps employed in forming an adapter in accordance with the present invention.
Figure 7:
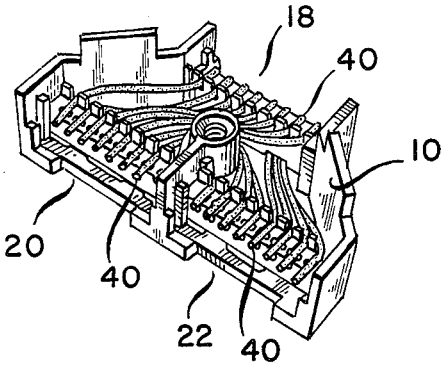

As shown in FIGS. 6, 7 and 8, various installation steps are shown which will provide an adapter having an input plug and two output jacks, such as that shown in FIG. 12.

Referring now to FIG. 6, housing 10 accommodates adjacent output ports 20 and 22, a pair of inserts members 40. A third insert member 40, shown removed from housing 10, includes a plurality of discrete lengths of insulated conductors 80 therein. Conductors 80 are used as jumper wires to electrically connect the input port 18 to the outport ports 20 and 22. Conductors 80 may be color coded, insulated electrical wires which are similar in size and shape to that employed typically in telecommunications cable. In the present illustrative embodiment eight conductors are shown. However, a lesser number of conductors may be employed leaving selected ones of the channel 44 in insert 40 empty. A central portion of the conductors are accommodated by insert 40, each disposed in a unique one of the discrete channels 44. One end of each of the eight conductors extends toward one of the output port 20 and the other ends of the conductors 80 extend beneath the insert device through a pair of passages 41 and 43 (FIG. 2) toward the other output port 22. The insert 40 including the conductors 80 is then inserted into housing 10 through slots 26 adjacent input port 18, as shown in FIG. 7. All sixteen ends of conductors 80 are then inserted or "dressed" into the channels 44 of the other two insert members 40 (eight in each) adjacent output ports 20 and 22. The schematic arrangement of the conductors 80, in the respective inserts, are dictated by the particular wire diagram and by an industry pattern. In this position the conductors 80 may now be terminated with a jack 50 or plug 60 in any desired combination.

As shown in FIG. 8, the particularly described configuration includes termination at the input port 18 with a plug 60 and termination at output port 20 and 22 with a jack 50. Termination is accomplished by use of a hand tool 91 as descrioed in the above-identified U.S. patent application. The cover 32 may be then brought down upon the housing 10 to secure the modular connector, i.e., plug 60 and jacks 50, in the housing 10. Screw 82 or other conventional fastening means may secure the cover 32 to housing 10.

Figure 9:
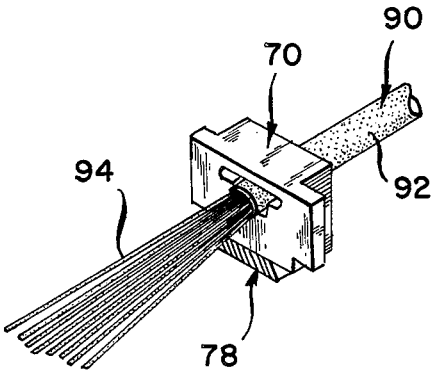

Referring to FIGS. 9 and 10, termination of a telecommunications cable in a splitter may be described.

FIG. 9 shows a conventional telecommunications cable 90 having an outer insulative jacket 92 and a plurality of insulated conductors 94 extending therethrough. Strain relief attachment member 70 is inserted over the jacket 92 adjacent the end thereof. Engagement member 78 is crimped down upon jacket 92 to partially close off aperture 72 to secure the cable 90 in the attachment member.

Referring now to FIG. 10, the attachment member 70 securing cable 90, may be inserted into the input port 18 of housing 10. Four designated conductors 94 are dressed in each of the insert members 40 held adjacent output ports 20 and 22. The cable 90 is now in position to be terminated by modular connectors of either the jack 60 or plug type 50 in a manner substantially shown in FIG. 8.

It can be appreciated that due to the modularity of the connectors a variety of splitters and adapters can be formed. Three of the most popular combinations are shown in FIGS. 11, 12 and 13 where typically the output connectors are in the jack configuration. The input can be a modular connector of the jack or plug configuration or can split a conventional telecommunications cable.

Various changes to the foregoing described and shown structures would now be evident to those skilled in the art. Accordingly, the particularly disclosed scope of the invention is set forth in the following claims.

We claim:

1. A kit of parts for field assembly of telephone connection apparatus comprising:

a body member having an input port and an output port therein;

a first modular connector adapted for insertable attachment to said body member at said output port; said first connector having a termination end, a connection end and plural electrical contact elements each having a termination portion at said termination end and a contact portion at said connection end;

an attachment assembly adapted for insertable attachment adjacent said input port; said attachment assembly being of either a first or second type, said first type including a second modular connector having a termination end, a connection end and plural electrical contact elements each having a termination portion at said termination end and a contact portion at said connection end and connection means for electrically connecting said termination portion of said contact elements of said first connector with said termination portions of said contact elements of said second connector, said second type including an attachment member having a body and a central aperture therethrough for supporting a multiconductor cable in non-movable disposition therein, said cable being supported in a manner whereby conductors of said cable are disposed for connection to said termination portions of said contact elements of said first connector, said input portion accommodating alternatively said attachment assembly of said first and second type; and a cover engagable with said body member for holding said first connector and said attachment assembly in said body member.

2. A kit of parts of claim 1 wherein said contact elements include insulation displacing elements at said termination portions.

3. A kit of parts of claim 1 wherein said attachment member is a strain relief device.

4. A kit of parts of claim 1 wherein said body member includes one input port and two output ports.

5. A kit of parts of claim 4 wherein said output ports each accommodates a modular connector.

6. A kit of parts of claim 5 wherein each of said modular connectors is formed in either a jack or plug configuration.

7. A kit of parts of claim 3 wherein said connection means includes plural lengths of insulated electrical wire adapted for connecting termination portions of contact elements of said first connector to termination portions of contact elements of said second connector.

8. A kit of parts of claim 7 further including an insert member adapted for insertable positioning in said housing adjacent said input port; said insert member adapted to accommodate said lengths of insulated electrical wire.

* * * * *